US005513491A

United States Patent [19]

Broenner et al.

[11] Patent Number: 5,513,491

[45] Date of Patent: May 7, 1996

[54] HYDRAULIC VIBRATION DAMPING SYSTEM FOR MACHINES PROVIDED WITH TOOLS

[75] Inventors: Guenter Broenner, Kissing; Walter Kolb, Augsburg, both of Germany

[73] Assignee: O&K Orenstein & Koppel AG, Berlin, Germany

[21] Appl. No.: 199,311

[22] PCT Filed: Sep. 2, 1992

[86] PCT No.: PCT/EP92/02019

§ 371 Date: Mar. 2, 1994

§ 102(e) Date: Mar. 2, 1994

[87] PCT Pub. No.: WO93/05244

PCT Pub. Date: Mar. 18, 1993

[30] Foreign Application Priority Data

Sep. 4, 1991 [DE] Germany ..... 41 29 319.3
Jul. 3, 1992 [DE] Germany ..... 42 21 943.4

[51] Int. Cl.[6] ..... F16D 31/02

[52] U.S. Cl. ..... 60/413; 60/469; 60/494

[58] Field of Search ..... 60/413, 416, 469, 60/468, 494, 420, 477; 91/461

[56] References Cited

U.S. PATENT DOCUMENTS

| | | | |
|---|---|---|---|
| 3,872,670 | 3/1975 | Dezelan et al. . | |
| 4,590,763 | 5/1986 | Augoyard et al. | 60/416 X |
| 4,674,280 | 6/1987 | Stuhr | 60/416 X |
| 4,731,997 | 3/1988 | Hagin | 60/416 |
| 5,034,892 | 7/1991 | Saotome | 60/469 X |
| 5,245,826 | 9/1993 | Roth et al. | 60/420 X |

FOREIGN PATENT DOCUMENTS

| | | |
|---|---|---|
| 0381788A1 | 8/1990 | European Pat. Off. . |
| 3909205C1 | 5/1990 | Germany . |
| 90/05814 | 5/1990 | WIPO . |

*Primary Examiner*—Hoang Nguyen
*Attorney, Agent, or Firm*—Spencer & Frank

[57] ABSTRACT

A hydraulic system for machines provided with tools, particularly for wheel loaders, fork lifts or the like, including comprising at least one hydraulic accumulator, distributing valves, manometric switches and at least one nozzle for variably adapting the load pressure of the hydraulic accumulator to the load pressure of the lifting cylinder, wherein the load-damping system formed by the hydraulic accumulator is connected to the hydraulic lines responsible for lifting and lowering and extending between the hydraulic cylinder(s) and a control valve.

8 Claims, 2 Drawing Sheets

HYDRAULIC VIBRATION DAMPING SYSTEM FOR MACHINES PROVIDED WITH TOOLS

BACKGROUND OF THE INVENTION

The invention relates to a hydraulic system for machines provided with tools, particularly for wheel loaders, fork lifts or the like, having a load-damping system comprising at least one hydraulic accumulator connected to the hydraulic lines responsible for lifting and lowering the tool and that extend between the lifting cylinder and a control valve.

Construction machines having pneumatic tires must often travel a long distance when they are to be used at a construction site. They can be driven between construction sites and to their locations of use, because they fulfill the conditions of admission for participation in public traffic, even with trailers from time to time.

The driving speeds that can be attained during use contribute significantly to the transport capability and thus the economical aspect of the machine. However, even for tools that must be transported frequently between construction sites, or must use lengthy routes to reach these sites, the time required to do this is a significant factor in the cost calculation of the contractor.

The driving speed of this type of machine is not limited by the engine capability—with the exception of driving on steep gradients—but by the vibrations the vehicle experiences due to unevenness of the ground. The driver is thus obligated to select a speed considerably below the speed that could be attained. The primary cause of the "bumping" of the machine is the lack of a spring system. Up to now, spring systems have only been constructed in construction machines for special purposes, for example in military applications with the requirement of speeds up to over 60 km/h. The reasons these types of construction machines are built without spring systems are, on the one hand, that a spring system, because of its yielding under lifting and tensile forces, would be disadvantageous during loading. On the other hand, installing a spring system represents a relatively high construction expenditure that would by nature have to result in considerable additional costs.

From DE-C 3,909,205, a hydraulic system is known for construction machines, particularly wheel loaders, tractors and the like, that include a tool, particularly a loading shovel, that is operated by a hydraulic cylinder, wherein a main line is provided for operating the hydraulic cylinder that leads from a pressure source to the hydraulic cylinders via a control valve, from which line a connecting line that leads to at least one hydraulic accumulator branches off, and in which a switchable check valve is disposed. A feed line is provided that bridges the check valve and connects the main line to the hydraulic accumulator, and a pressure-reducing valve is disposed in the feed line. The pressure-reducing valve is set to the carrying pressure of the hydraulic cylinder, and is preferably configured as a pressure-limiting valve or as a pressure cut-off valve. The switchable check valve is configured as a magnet valve that is controlled as a function of the driving speed or the tilting angle of the tool, wherein during driving speed-dependent control of the magnet valve, the switching point is set such that it cannot be exceeded until second gear is reached.

Because only one predeterminable carrying pressure (e.g. 120 bar) can be set in the use of pressure-reducing valves, which cannot be viewed as being a realistic value in every working state, the load-damping system used here is viewed as inadequate for all operating states of the machine. Moreover, the gear- or driving speed-dependent switching of the pressure-reducing valve likewise cannot optimally manage the pitching vibrations established in the operating state.

SUMMARY OF THE INVENTION

The goal of the subject of the invention is to provide a damping system for the tool or the lifting device cooperating therewith such that pitching vibrations of the machine, particularly those occurring with unfavorable road surfaces, can be reduced.

This goal is achieved in accordance with the invention in that at least one nozzle connected to a plurality of distributing valves is provided between the load-damping system and the lifting cylinder for variably adapting the load pressure of the hydraulic accumulator to the respective load pressure of the lifting cylinder, wherein the valves can be operated via manometric switches, and the load-damping system can be activated or deactivated as a function of predeterminable operating states.

The hydraulic system of the invention is particularly suited for conveying and transport trips with an empty or loaded tool.

If the driver operates the pilot control actuator, the distributing valves are shifted into the neutral position by means of the manometric switches cooperating with the pilot control actuator, and the load-damping system is disconnected. The hydraulic pressure in the hydraulic accumulator is adapted via the nozzle to correspond to the load pressure in the lifting cylinder. If the driver again puts the pilot control actuator into the neutral position, the load-damping system is automatically activated. After the load pressure has nearly been adapted via the nozzle in the hydraulic accumulator, no notable sinking of the tool takes place during automatic deactivation. However, to guard against unacceptable spring deflections of the lifting cylinder(s) via the hydraulic accumulator, the load-damping system is automatically deactivated via an inductive switch at a specific lifting height.

BRIEF DESCRIPTION OF THE DRAWINGS

The subject of the invention is described in detail by way of an embodiment. Shown are in.

DETAILED DESCRIPTION OF THE INVENTION

Figure 1:
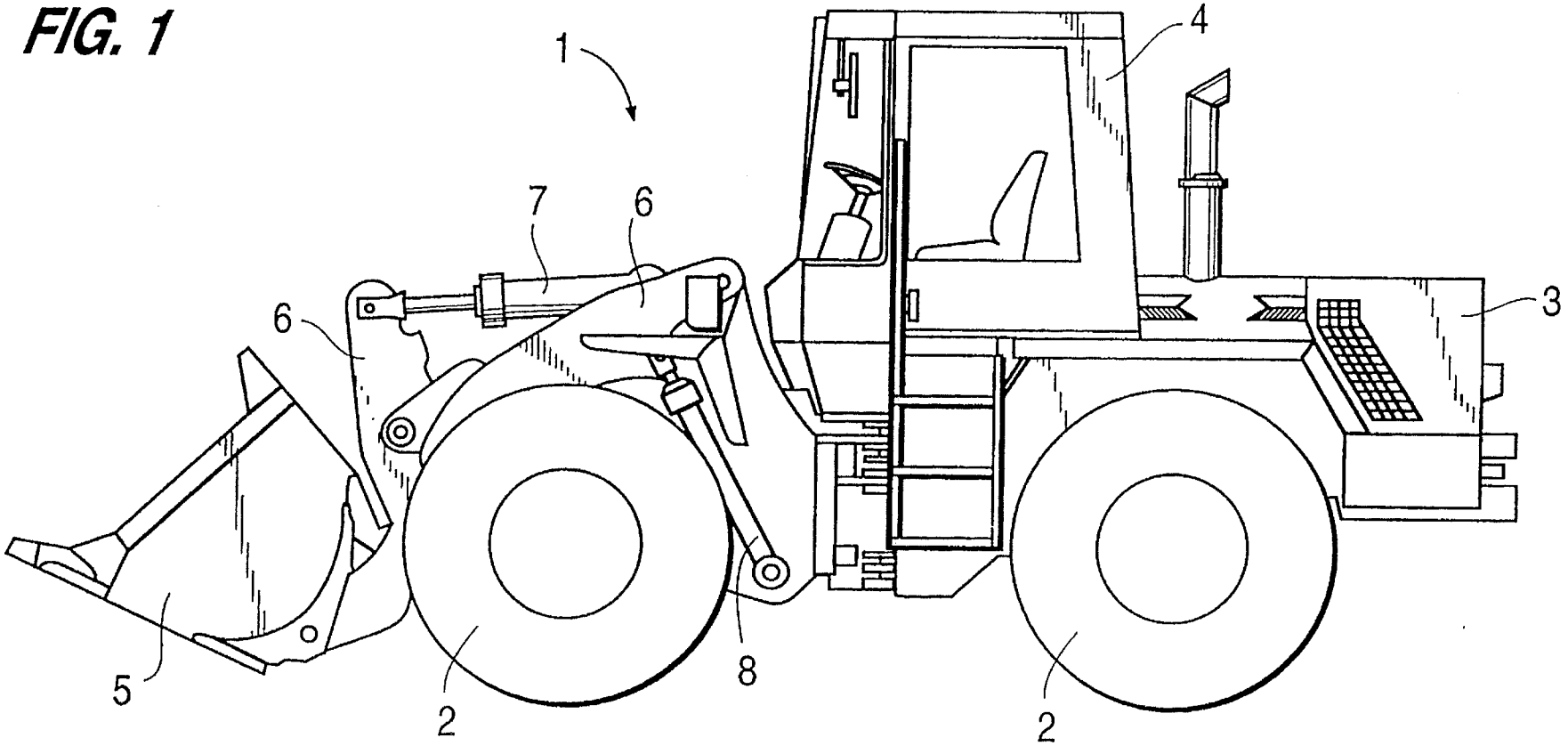
FIG. 1—representation of a wheel loader.

As a fundamental representation, FIG. 1 shows a wheel loader 1 that can travel on pneumatic tires 2. The wheel loader 1 includes, among other features, a chassis 3 that has a driver's cab 4, and a bucket 5 seated to pivot on a mounting assembly 6, the mounting assembly 6 being connected to a plurality of hydraulic cylinders 7, 8 provided for the purpose of lifting and tilting the bucket 5.

Figure 2:
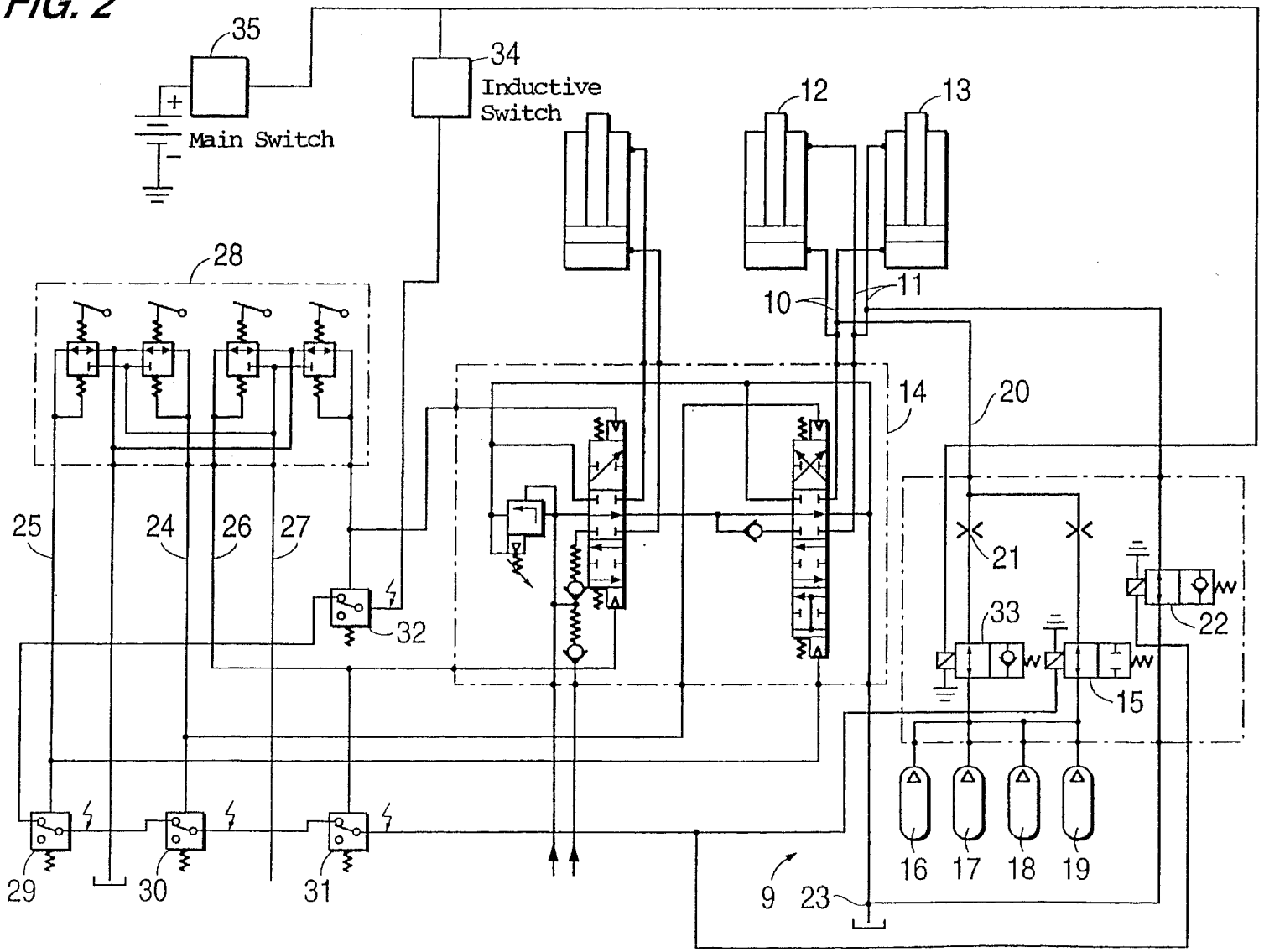
FIG. 2—hydraulic circuit diagram for the wheel loader of FIG. 1.

FIG. 2 shows the hydraulic circuit diagram 9 (load-damping system) for the wheel loader 1 shown in FIG. 1, wherein it is carefully pointed out that this circuit diagram can be applied in the same manner to other tools, for example a fork lift. In accordance with hydraulic circuit diagram 9, the load-damping system is connected to the hydraulic lines 10, 11 responsible for lifting and lowering, respectively, and that extend between the lifting cylinders 12, 13 and the control valve 14. The hydraulic line 10 responsible for lifting is connected via a 2—2-way valve 15—blocked in the neutral position, free passage in the shift position—to one or a plurality of hydraulic accumulators 16, 17, 18, 19. The hydraulic accumulators 16–19 have a vehicle-specific gas bias. A nozzle 21 is located on the lifting side 10 in the bypass 20 between the hydraulic accumulators 16–19 and lifting cylinders 12, 13. The hydraulic line 11 responsible for lowering is connected via a further 2—2-way valve 22—blocked in the neutral position, free passage in the shift position—to the return conduit 23. Manometric switches 29, 30, 31, 32 are located in the pilot control lines 24, 25, 26, 27 (lifting, lowering, upward tilting, downward tilting), between the pilot control actuator 28 and the control valve 14. On the front frame of the wheel loader 1, which has no further reference numerals, an inductive switch 34 is provided at a predetermined height.

A main switch 35 is disposed in the driver's cab 4 of the wheel loader 1 for activating and deactivating the load-damping system. When the load-damping system is activated via the main switch, and the pilot control actuator 28 is in the neutral position, the 2—2-way valves 15, 22 in the lifting line 10 and the lowering line 11 switch to free passage. The lifting side 10, that is, lifting cylinders 12, 13, are thus connected to the hydraulic accumulators 16–19. The hydraulic line 11 responsible for lowering that is, lifting cylinders 12, 13, are consequently connected to the return conduit 23. Pitching movements of the wheel loader 1 caused by unevenness in the road are hence variably damped and reduced, e.g. as a function of the respective operating state, permitting high driving speeds.

If the driver operates the pilot control actuator 28, the 2—2-way valves 15, 22 are switched into the neutral position by means of the manometric switches 29–32, and the load-damping system is deactivated. The hydraulic pressure in the hydraulic accumulators 16–19 is adapted via the nozzle 21 to correspond to the load pressure in the lifting cylinders 12, 13. If the driver again puts the pilot control actuator 28 into the neutral position, the load-damping system is automatically deactivated. After the load pressure in the hydraulic accumulators 16–19 has been variably adapted to the respective operating state via the nozzle 21, no notable sinking of the bucket 5 or the mounting assembly 6 results.

As a guard against unacceptable spring deflections of the lifting cylinders 12, 13 via the hydraulic accumulators 16–19, the load-damping system is automatically deactivated at a predetermined lifting height via the inductive switch 34 on the frame of the wheel loader 1. For specific applications, it can be necessary in the operating state of the wheel loader 1 to deactivate the nozzle 21, for example by means of a magnet valve 33.

The function of the hydraulic system of the invention is intended to be clarified by way of a practical example.

During empty runs (empty bucket), the cylinders 12, 13 are under a pressure of, for example, 30 bar, and the hydraulic accumulators 16–19 are under their own prestress of 18 bar. Because of these pressures, the highest driving speeds can be achieved during empty travel, wherein vibrations, particularly pitching vibrations, can be suppressed to the greatest extent.

During loading of the bucket 5, the valves 15 and 22 are switched to neutral via the manometric switches 29–32, and the valve 33 is switched to passage. The hydraulic accumulators 16–19 are brought to the respective operating pressure via the pressure generated by the pump, not shown, and the nozzle 21. This can result in a pressure of approximately 200 bar when the pressure in the hydraulic cylinders 12, 13 is 200 bar.

On the wall, a cylinder carrying pressure of 180 bar would be established, for example via the magnet valve 33, in the region of the hydraulic cylinders 12, 13, whereas the accumulator pressure would approach this magnet value via the valve 33 and the nozzle 21 in order to bring about a balance in this manner. As soon as the driver operates the pilot control actuator 28, the valves 15 and 22 are switched open via the manometric switches 29–32, so that the hydraulic accumulators 16–19 are connected to the cylinders 12, 13. As already addressed, at a predetermined lifting frame height the inductive switch 34 is operated, and the load-damping system is deactivated.

we claim:

1. The hydraulic system for wheel loaders provided with a shovel, comprising:

at least one lifting cylinder;

a control valve;

a plurality of hydraulic lines each connected to and extending between said at least one lifting cylinder and said control valve for lifting and lowering the shovel;

a load-dumping system comprising at least one hydraulic accumulator connected to said hydraulic lines;

a plurality of distribution valves;

at least one nozzle in connection with said plurality of distribution valves and located between said at least one hydraulic actuator and said at least one lifting cylinder for variably adapting a load pressure of said at least one hydraulic accumulator to a respective load pressure of said at least one lifting cylinder;

a pilot control actuator;

a plurality of pilot control lines connecting said pilot control actuator and said control valve; and a plurality of manometric switches each located within a respective pilot control line between said pilot control actuator and said control valve for operating said distribution valves; whereby said load-damping system is activated and deactivated as a function of a predetermined operating state.

2. The hydraulic system as defined in claim 1, wherein said distribution valves are 2—2-way valves.

3. The hydraulic system as defined in claim 1, further comprising a bypass line located between said load-damping system and a lifting side of said at least one hydraulic cylinder, said nozzle being located in said bypass line.

4. The hydraulic system as defined in claim 1, wherein the wheel loader includes a front frame; further comprising at least one switch located at a predetermined height on the front frame.

5. The hydraulic system as defined in claim 4, wherein said switch comprises an inductive switch.

6. The hydraulic system as defined in claim 1, wherein the wheel loader includes a driver's cab; further comprising a main switch located in the driver's cab for activating said load-damping system.

7. The hydraulic system as defined in claim 1, further comprising an additional valve having a closed position for deactivating said nozzle.

8. The hydraulic system as defined in claim 7, wherein said additional valve comprises a magnet valve.

* * * * *